US005461982A

United States Patent [19]

Boyer, III

[11] Patent Number: 5,461,982

[45] Date of Patent: Oct. 31, 1995

[54] MISSILES HAVING MEANS FOR MARKING TARGETS DESTROYED BY SAID MISSILES TO PREVENT FURTHER EXPENDITURE OF MUNITIONS TO SAID TARGET

[76] Inventor: Lynn L. Boyer, III, 2202 Manassas Dr., SW., Huntsville, Ala. 35803

[21] Appl. No.: 93,485

[22] Filed: Jul. 19, 1993

[51] Int. Cl.[6] ..... F42B 12/40

[52] U.S. Cl. ..... 102/513; 102/473

[58] Field of Search ..... 102/513, 473, 102/703; 244/3.12, 3.16, 3.19

[56] References Cited

U.S. PATENT DOCUMENTS

| | | | |
|---|---|---|---|
| 684,653 | 10/1901 | Tubini | 102/513 X |
| 1,099,549 | 6/1914 | Hoagland | 102/513 |
| 2,409,380 | 10/1946 | Nichols | 102/513 |
| 2,592,434 | 4/1952 | Krasnow | 102/513 |
| 3,712,228 | 1/1973 | Handler | 102/513 |
| 4,326,463 | 4/1982 | Burke et al. | 102/513 |
| 4,394,997 | 7/1983 | Maudal | 244/3.16 |
| 4,448,106 | 5/1984 | Knapp | 102/513 |
| 5,009,164 | 4/1991 | Grinberg | 102/513 |
| 5,280,751 | 1/1994 | Muirhead et al. | 102/513 |

*Primary Examiner*—Harold J. Tudor

*Attorney, Agent, or Firm*—John C. Garvin, Jr.; Harold W. Hilton

[57] ABSTRACT

A semi-permanent market material is carried by a missile, along with a warhead, to a target and responsive to impact of the warhead with the target, the identification material is released and applied to the "killed" target thereby providing for instantaneous and also future identification of the "killed" target.

16 Claims, 4 Drawing Sheets

MISSILES HAVING MEANS FOR MARKING TARGETS DESTROYED BY SAID MISSILES TO PREVENT FURTHER EXPENDITURE OF MUNITIONS TO SAID TARGET

FIELD OF THE INVENTION

This invention generally relates to marker devices incorporated in a missile having a warhead for impacting a target. The marker is released on the target responsive to impact of the warhead with a target. More particularly the invention relates to such a missile which is used in the destruction of armored vehicles or the like.

BACKGROUND OF THE INVENTION

The invention relates to a semi-permanent identification medium and a dispensing mechanism being placed in/on or made an integral part of precision, guided, integrally propelled or freefall and direct fire anti-armor munitions, such that upon the munitions impacting and thus "killing/destroying" an enemy vehicle, the semi-permanent, identification medium is applied to the vehicle. Because of the applied identification material, the "killed/destroyed" threat armored vehicle is able to be quickly and easily recognized by engaged and succeeding combat crews as being "killed/destroyed" and thus no longer a threat and that no further munitions need be expended at the "destroyed target".

Since the advent of armored vehicles on the battlefield in World War I, there have been two continued, parallel military efforts. One has been to improve the armored vehicle and the other has been to find newer and better methods to defeat the armored vehicle. The tank and other armored vehicles have improved in quality and engineering sophistication, so that the traditional, bullet type, solid shot, is no longer adequate to defeat armor. It now takes specific, costly, and technologically unique weaponry. The method of defeating modern armor has changed. Previously, solid shot and explosive weapons destroyed the armored vehicle by blast or mechanical force to sunder it to pieces. Current anti-armor munitions use shaped charges or specifically shaped solid projectiles (especially flechettes) that pierce the armored vehicle and render it immobile by destroying sensitive vehicle components or killing the crews. Occasionally these projectiles cause complete or catastrophic destruction of an armored vehicle by igniting the internally carried ammunition or fuel. Most times, however, the armored vehicle, though destroyed or combat immobilized, appears, without close-up inspection or extended observation, unscathed.

Anti-armor warfare has evolved from the practice of defeating enemy armor by massed fire or bombing, to one, while not excluding massed fire and bombing, of using precision munitions to destroy individual vehicles, frequently at distances previously not practical. Wide ranging attack helicopters, fixed wing aircraft carrying smart anti-armor munitions, artillery firing smart munitions and friendly armored thrusts, have combined to give modern battlefields breadth and depth, unimaginable but a few years ago. The high probability of kill (PK) combined with the continuing evolution of anti-armor munitions into smaller and smaller weapons has made light forces (attack helicopters, wheeled vehicles—such as anti-armor missile carrying jeeps and light trucks) and even individual infantry men so armed, into potent anti-armor forces.

The enlarged field of combat, and fluid, high intensity nature of armored conflict, means that significant numbers of "killed/destroyed" enemy armor will be encountered, by friendly forces, numerous times. Distinguishing active threats from neutralized armored vehicles assumes increased import, especially when multiple enemy armored vehicles, all of the same appearance, are encountered. Survivability of friendly crews will often depend upon their ability to quickly distinguish and engage active enemy as opposed to engaging those that appear active but have in fact been previously destroyed.

The lethality due to the high PK of extant and planned precision guided weapons and direct fire anti-armor munitions is such that they frequently impact and "kill/destroy" modern armored vehicles without causing apparent damage or obvious destruction of these vehicles. In fact, the impact signature of precision direct rounds is frequently so small that in the Southwest Asia Conflict, Desert Storm, tank gunners were known to fire a second round at an enemy armored vehicle, before the first round struck, because they did not see the small impact signature of the first round until after they fired a second round. The gunners were not looking for destruction of the armored vehicle, but for the small signature of their munitions impact. Because the destruction is not apparent or catastrophic (and frequently not recognizable without close-up inspection), "killed/destroyed" threat armored vehicles appear as viable enemy and are "killed/destroyed" multiple times. Post conflict examination of "killed" armored vehicles, from the 1973 Arab/Israeli conflict as well as the recent Desert Storm experience, provide compelling evidence that armored vehicles are shot and hit multiple times after being "killed/destroyed".

The invention will provide gunner's, including the original, both during an immediate engagement and in succeeding encounters, with specific means of identifying which enemy vehicles have been "hit" as opposed to those which are still active threats. This ability will improve friendly gunner situational awareness, active threat identification (i.e. those not displaying identification material and more probably still capable of hostile actions), combat efficiency/effectiveness and reduce friendly casualties.

For succeeding gunner's, easy, obvious identification of "destroyed/killed" enemy vehicles will, especially in combat scenarios involving possible multiple enemy armored vehicles, provide increased probability of engaging enemy vehicles that are active threats, decrease munitions expenditures, make those rounds expended more effective, reduce exposure to active threats through not engaging non-threats, improve combat effectiveness and efficiency of friendly forces and reduce combat duration through more effective application of anti-armor munitions.

It is known from the prior art that dye marker material has been used in conjunction with missiles for marking targets. For example, U.S. Pat. No. 4,326,463, issued Apr. 27, 1982 is directed to a dye marker assembly for a rocket practice round. The inert training round utilizes a frangible nose cone (instead of an active warhead) to impact a target. Upon impact the nose cone does not penetrate or destroy the target but ruptures to release a dye marker for creating a dye cloud visible within a range of 3000 meters to indicate to the pilot/gunner the accuracy of his aim.

U.S. Pat. No. 5,009,164 issued Apr. 23, 1991 is directed to a non-penetrating projectile which stains a target upon impact. The projectile is provided with means for changing its shape on impact to reduce the danger of penetration into a target such as a human. The device is used to disperse a crowd and to mark the individuals of the crowd as an aid in subsequent identification of involved persons.

Some other patents relating to missiles employing target marking means are: U.S. Pat. No. 3,712,228, issued Jan. 23, 1973, and U.S. Pat. No. 4,448,106 issued May 15, 1984.

None of the above patents disclose a missile having the combination of an active warhead and target identification means carried by the missile to a target so that upon impact of the warhead with the target, the target is "killed" (although it may not be totally visibly destroyed) and marked by the identification means to instantaneously and thereafter provide a means of identifying the "killed" target.

It is, therefore, an object of the present invention to provide a means for identification of a target responsive to impact therewith by a warhead of a missile.

It is a further object of the present invention to provide such a missile with the identification means as a discrete element of the missile structure which is separate and distinct from the warhead.

These and other objects of the present invention will become more readily apparent from the following description, drawings and claims.

The term "warhead" as used herein refers to that portion of the missile which impacts with the target to "kill" the target. The "warhead" may be an armor piercing warhead which penetrates the target to damage internal components of the target and thus effectively "kill" the target. Or, the warhead may contain an explosive which, upon impact, effectively "kills" the target.

BRIEF DESCRIPTION OF THE DRAWINGS

FIGS 8 and 9 illustrate the reservoir 12 as having an annular frangible member around the periphery thereof.

DESCRIPTION OF THE PREFERRED EMBODIMENTS

Figure 1:
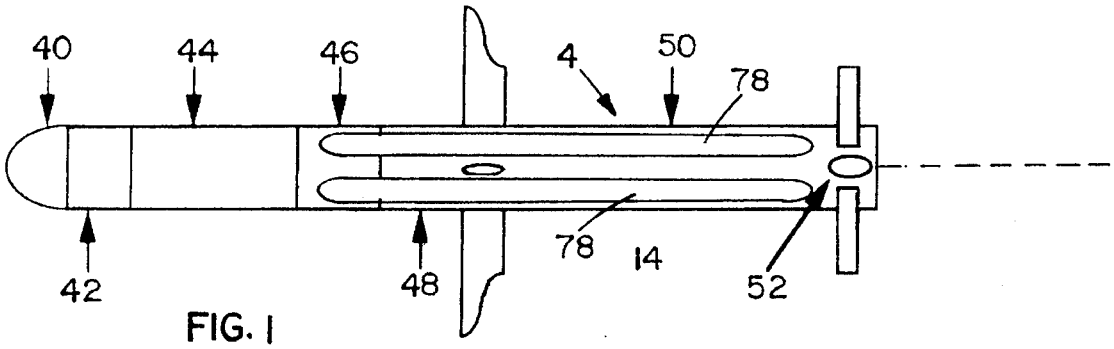
FIG. 1 is an elevational view of a typical wire guided anti-armor missile having target identification material disposed in strakes carried at predetermined positions on the body of the missile.
Figure 2:
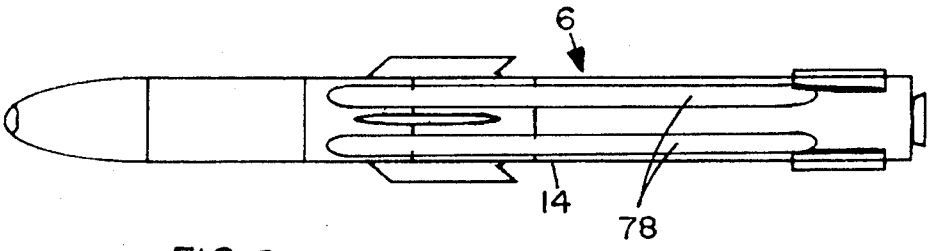
FIG. 2 is an elevational view of a typical radar/millimeter wave/laser/optically guided anti-armor missile having target identification material disposed in strakes carried at predetermined positions on the body of the missile.
Figure 4:
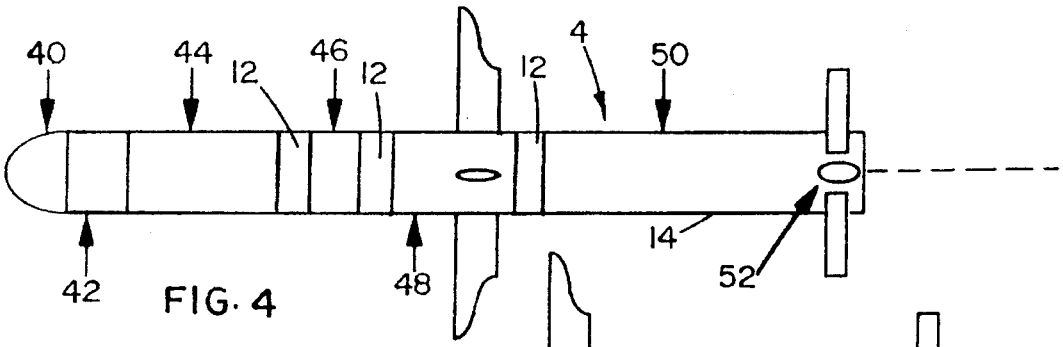
FIG. 4 is an elevational view of the typical wire guided anti-armor missile of FIG. 1 and illustrates marker (identification) material containing reservoirs mounted in the body of the missile target.
Figure 5:
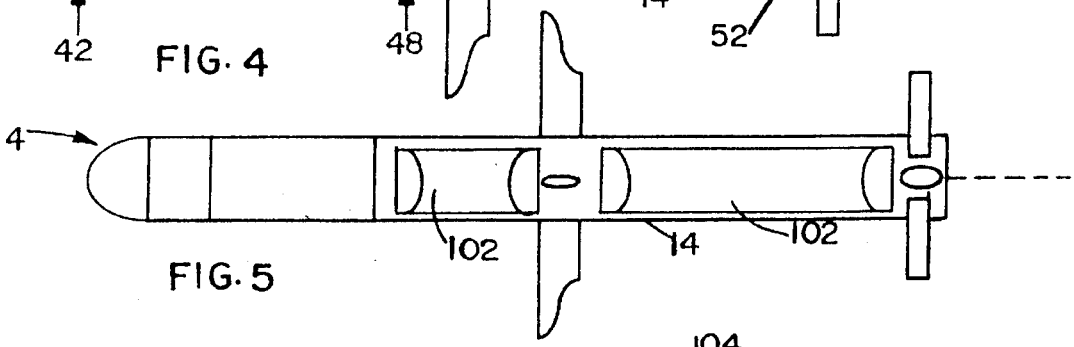
FIG. 5 is an elevational view of the typical wire guided anti-armor missile of FIG. 1 and illustrates marker (identification) material containing packet/conformal containers mounted on the body of the missile.
Figure 6:
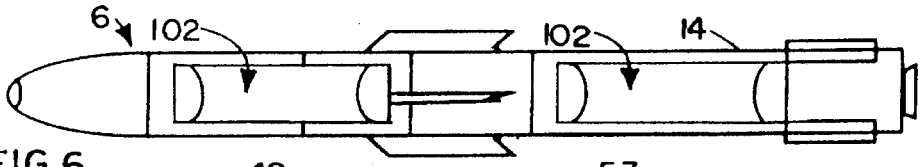
FIG. 6 is an elevational view of a typical radar/millimeter wave/laser/optically guided anti-armor missile and illustrates packet/conformal containers mounted on the body of the missile.
Figure 7:
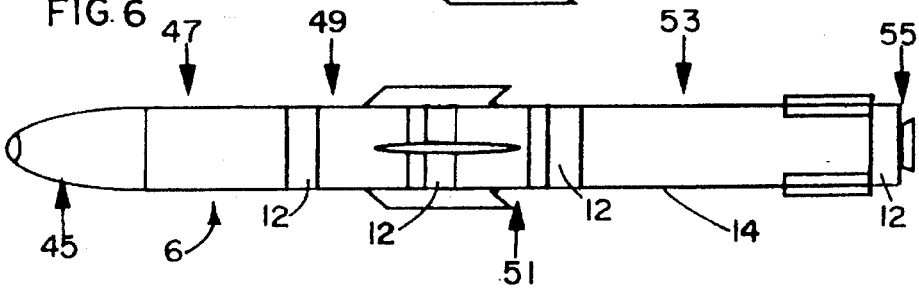
FIG. 7 is an elevational view of a typical radar/millimeter wave/laser guided anti-armor missile and illustrates material containing reservoirs mounted on the body of the missile.
Figure 10:
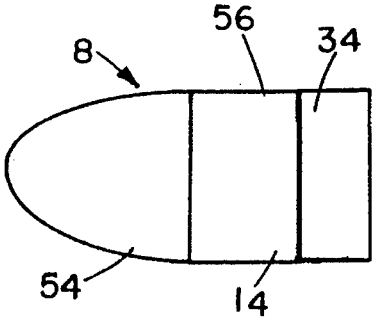
FIG. 10 is an elevational view of a solid shot missile projectile using a marker material container reservoir mounted on the body of the solid shot projectile.
Figure 11:
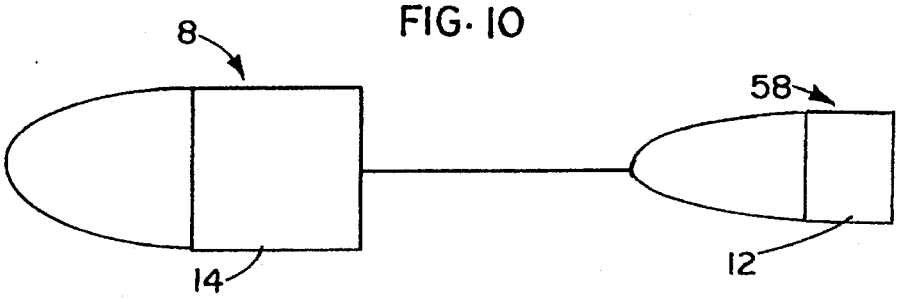
FIG. 11 is an elevational view of a solid shot missile projectile having a trailing body such as a free flying shell or ballute, the trailing body having marker material carried therein.
Figure 12:
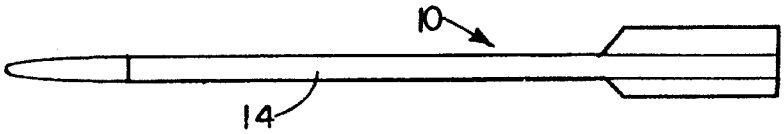
FIG. 12 is a side elevational view of a missile in the form of a flechette or dart having a marker material reservoir mounted therein.
Figure 13:
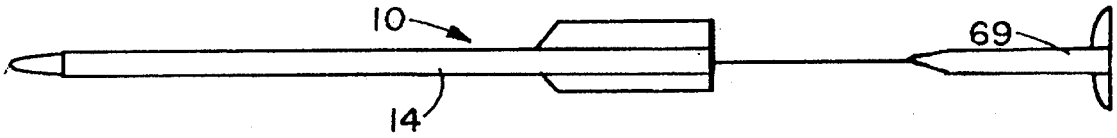
FIG. 13 is an elevational view of a flechette or dart having a trailing body such as a free flying dart or ballute.

FIGS. 1, 4 and 5 illustrate a typical wire guided anti-armor missile 4 utilizing the target marking principles of the present invention and FIGS. 2, 6 and 7 illustrate a typical radar/millimeter wave/laser/optically guided anti-armor missile 6 utilizing the target marking principles of the present invention. FIG. 10 illustrates a missile 8 as being a shot projectile and FIG. 11 illustrates the shot projectile 8 of FIG. 10 as having a trailing body in the form of a free flying shell or ballute attached to the missile. FIG. 12 illustrates a missile 10 as being a flechette or dart and FIG. 13 illustrates the flechette 10 of FIG. 12 as having a trailing body in the form of a free flying shell or ballute attached thereto.

Figure 16:
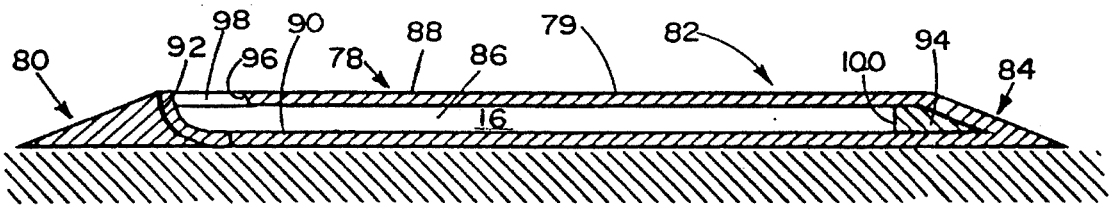
FIG. 16 is a cross-sectional view of a container which encloses a marker material in accordance to the principles of the present invention. The container (which may be a strake or packet/conformal container) is shown to have a marker material ejection plug therein. An initiator is shown mounted in the strake.
Figure 17:
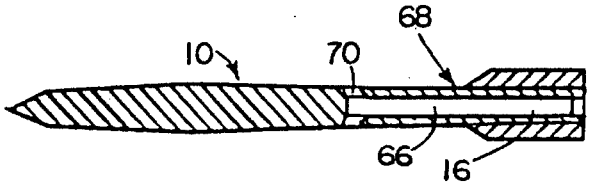
FIG. 17 is a cross-sectional view of the flechette or dart of FIG. 12 showing the marker material reservoir disposed in the body of the missile. Blow out plugs are shown around the periphery of the reservoir.
Figure 18:
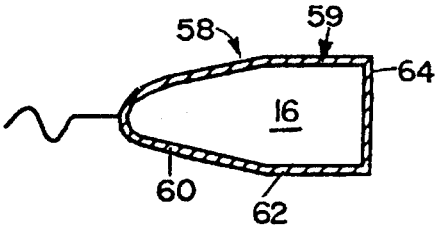
FIG. 18 is a cross-sectional view of the trailing or free flying shell or ballute of FIG. 11 illustrating the marker material therein.
Figure 19:
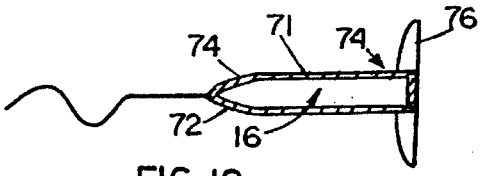
FIG. 19 is a cross-sectional view of the trailing or free flying dart or ballute of FIG. 13 illustrating the marker material therein.
Figure 20:
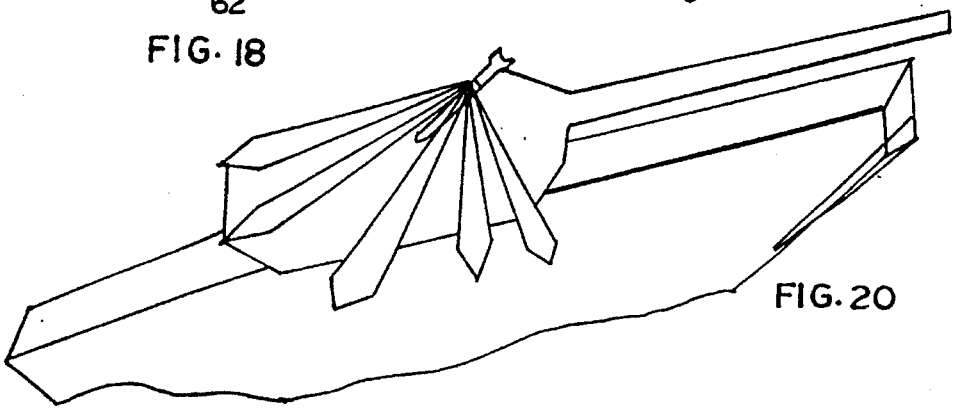
FIG. 20 is a pictorial illustration of the marker material dispersion responsive to impact of the missile with an armored vehicle.

Each of the missiles respectively illustrated in FIGS. 4, 7, 10 and 17 are provided with a reservoir 12 mounted in the missile body 14 and having a powdered, jelled, solid or liquid marking (identification) material 16 carried therein (FIGS. 14–19). Each of the missiles shown in FIGS. 1, 2, 5, and 6 has the marker material carried in containers which are secured to the shell of the missile body. FIGS. 18 and 19 illustrate the marker material as being carried in a trailing body which is carried with the missile to the target. The target marking material "marks" the target subsequent to rupturing of the skin of the reservoir or container responsive to impact of the missile with the target.

Figure 14:
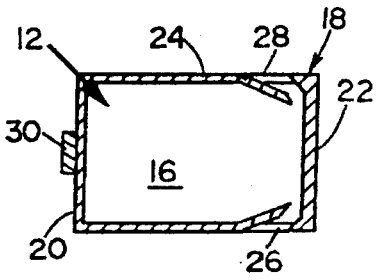
FIG. 14 is a cross-sectional view of a marker material reservoir employing the principles of the present invention. Marker material ejection soft plugs are shown mounted on the aft portion/periphery of the reservoir.

As seen in FIG. 14, reservoir 12 includes a housing 18 comprised of forward and aft bulkheads 20 and 22 respectively, which are connected by an annular side body member 24. Housing 18 encloses the identification material 16. Annular side member 24 is shown to include an ejection port 26 adjacent the aft end 22 thereof which is closed off by a soft sealing member 28 which forms an ejection soft plug. Member 28 may be a single annular member which extends around the periphery of body member 24, or if desired, may be plurality of peripherally spaced soft plug members. An initiator 30 may be provided in or adjacent the forward end 20 of the reservoir to rupture the reservoir and release the identification material. The initiator may be electrically, mechanically or explosively actuated. Such initiators are well known in the art.

Figure 15:
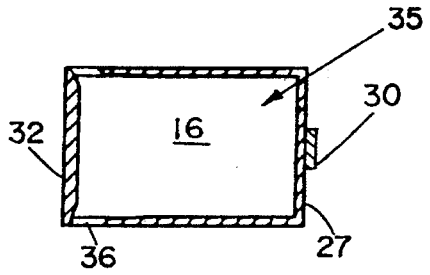
FIG. 15 is a cross-sectional view similar to FIG. 14 but illustrating the marker material ejection soft plugs at the forward portion of the reservoir.

FIG. 15 illustrates another embodiment of the reservoir which is identified by the numeral 35. Reservoir 35 contains the identification material 16 and is provided with ejection ports 36 similar to those of FIG. 14. The ejection ports are positioned adjacent the forward end 32 and the initiator 30 is shown positioned on the aft end 27 of the reservoir but may be a separate member mounted adjacent the reservoir, if desired. It is to be understood that reservoir 35 may be used in place of reservoir 12, if desired.

As seen in FIG. 4, wire guided missile 4 is shown to include serially arranged sections or compartments identified as seeker 40, electronics 42, warhead 44, computer 46, guidance 48, motor 50 and motor nozzle 52. First and second identification material reservoirs 12 are respectively shown mounted between the warhead section 44 and computer section 46 and between the computer section 46 and guidance section 48. A third reservoir 12 is shown mounted between guidance section 48 and motor section 50.

Figure 8A:
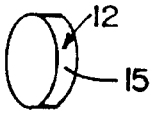
FIGS. 8*a* and 8*b* are pictorial and side elevational views, respectively, of the reservoirs used in FIGS. 4 and 7.
Figure 8B:
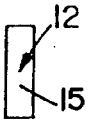

In the missile embodiment of FIG. 7 which illustrates the typical radar/millimeter wave/laser/optically anti-armor missile 6, a plurality of reservoirs 12 are serially positioned along the length of the body 14 of the missile in similar manner as discussed, supra, relating to FIG. 4. As seen in FIG. 7, the radar/millimeter wave/laser/optically guided anti-armor missile 6 is shown to include a seeker and electronics section 45, a warhead section 47, a computer section 49, a guidance section 51, a motor section 53 and a motor nozzle 55. In this missile a first reservoir 12 is shown to be positioned between the warhead and computer sections 47 and 49. A second reservoir 12 is shown to be positioned between the computer and guidance sections 49 and 51. A third reservoir 12 is shown to be positioned in the missile body between guidance section 51 and motor section 53. A fourth reservoir 12 is shown to be positioned at the motor nozzle section 55 adjacent the motor nozzle. As stated above, in the "Brief Description Of The Drawings", FIGS. 8*a* and 8*b* are pictorial and side elevational views, respectively, of the reservoirs used in FIGS. 4 and 7". However, FIGS. 8*a* and 8*b* further illustrates an embodiment of the invention wherein an annular frangible member 15 is disposed around the periphery of the reservoirs 12. The frangible member is disposed for rupturing responsive to impact to eject the marker material onto the destroyed target.

FIG. 10 illustrates the missile 8 as a solid shot having a forward portion 54 and an aft portion 56. A reservoir 34 is shown to be mounted at the aft portion 56 of the missile 8.

FIG. 11 is an elevational view of the missile 8 of FIG. 10 with a trailing body 58 connected thereto. The trailing body 58 is in the form of a free flying shell or ballute and contains the marker material 16 as shown in FIG. 18.

FIG. 18 illustrates in cross-section, the trailing of free flying shell or ballute 58 of FIG. 11. As seen in FIG. 18 the trailing body 58 (free flying shell or ballute) includes a housing 59 having the forward portion 60 thereof disposed for attachment to the solid shot 8. Shell or ballute 58 further includes a central section 62 and an aft section 64. The identification material is completely enclosed by forward, central and aft sections of the housing 59.

FIG. 17 illustrates the flechette or dart of FIGS. 12 and 13 in cross-section. An elongated reservoir 66 is shown to be carried in the aft end 68 of the flechette. The reservoir 66 includes a forward portion having blow-out plugs 70 (as discussed in conjunction with the discussion of FIGS. 14 and 15) mounted therein. The blowout plugs form a part of the outer shell of the flechette.

FIG. 19 illustrates the trailing or free flying dart or ballute of FIG. 13 in cross-section. The body 71 of the device completely encloses the identification material and is shown to include a forward portion 72 for attachment to the dart missile 10. Body 71 includes an aft portion 74 having stabilizing fins 76 thereon.

Figure 3A:
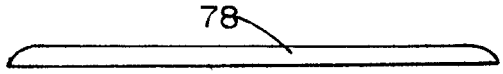
FIGS. 3*a*, 3*b* and 3*c* are top, side and front views, respectively, of the strakes shown in FIGS. 1 and 2.
Figure 3B:
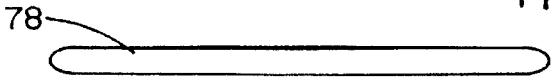
Figure 3C:
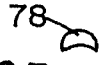

FIG. 16 is a cross-sectional view of a container in the form of a strake 78 as used in the missile of FIGS. 1 and 2. The strake is shown to be comprised of a body 79 having forward, intermediate and end portions 80, 82 and 84, respectively. The strake is shown to have a reservoir 86 enclosed by upper, lower, forward and rear end enclosures 88, 90, 92 and 94. Lower enclosure 90 may be the outer surface of the skin of the missile or may be a separate member which is attached to the missile body. The forward section 80 of the strake is provided with an ejection port 96 therein. Port 96 is enclosed by a skin or plug 98 which is softer than the material of which the strake is comprised. An initiator 100 may be provided, if desired, at the aft end 84 nestled between the juncture of lower and upper surfaces 88 and 90, respectively. The initiator may be electrically, mechanically, or explosively actuated. Such initiators are well known in the art. The strakes are better illustrated in FIGS. 3*a*, 3*b* and 3*c*.

A plurality of strakes 78 may be positioned on the missile as shown in FIGS. 1 and 2 which illustrate the strakes 78 as being mounted on the body of the missile and positioned between adjacent pair of the four stabilizing fins of the missiles.

Figure 9A:
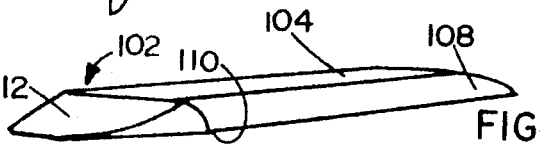
FIGS. 9*a* and 9*b* are pictorial and top views, respectively, of the packet/conformal containers used in FIGS. 5 and 6.
Figure 9B:
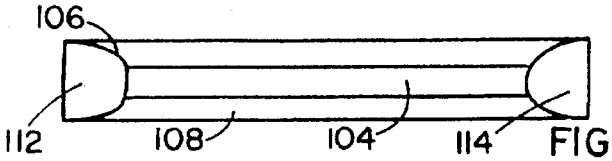

FIGS. 5 and 6 illustrate the use of packet/conformal containers 102 for carrying the marker material on the missiles 4 and 6. The packet/conformal containers are arranged in two serially arranged pairs with the pairs being positioned 180° apart on the missile body. The containers are aerodynamically configured so as to provide minimum drag on the missile. As seen in FIGS. 9*a* and 9*b*, each container 102 includes a substantially flat upper surface 104 and curved sides 106 and 108. Sides 106 and 108 curve outwardly and downwardly to mate with a base portion 110. A forward portion 112 is provided which slopes outwardly and downwardly to mate with base portion 110. In similar manner, a rear portion 114 is provided which slopes outwardly and rearwardly to mate with base portion 116. The marker material 16 is carried in the interior of the containers.

It is to be understood that the packet/conformal container is a container which is provided with a configuration which conforms to the general shape of the missile body but may or may not have outside aerodynamic surfaces. The strakes, as used in the present invention, however, are aerodynamically configured elongated members.

As stated above, the invention consists of the application of an identification medium as part of the destruction process due to precision, guided, self-propelled or free fall and direct fire, anti-armor munitions. The specific identification medium will be weapons systems dependent, i.e. it must be compatible with the particular system it is part of. Considerations for the identification medium will include type of medium to be dispensed, aerodynamics of the weapon, center of gravity considerations, weapon speed, impact angle and velocity, location of placement in or on the round, size of reservoir, number and type of reservoirs or containers, physical properties of the identification material, quantity of the identification material, and environment due to weapons impact. The identification medium will provide immediate and obvious indication that the armored vehicle has been "killed/destroyed" by any of several means or combinations thereof. Some examples of the identification material is as follows:

a. The identification medium may be a bright, that is non-combat/camouflage color, examples are fluorescent orange and yellow.

b. It may be a reflective material that causes the appearance of sparkles, such as prismatic or mirrored and/or glass fragments, shiney metal fragments or metalicized plastic strips or shards.

c. It may be fine strands of materials that reflect, pulse or present energy releases observable/detectable in the visual or non-visual spectrum.

d. It may be a material that changes the apparent silhouette of the armored vehicle in unusual ways, the application of an expandable foam, that dries quickly and puts lumps or bumps on the surface of the armored vehicle.

e. The material may be caustic and strip or eat away areas of paint and leave patches of bare metal.

f. The material may reflect directed energy (such as, for example, a laser beam) in any part of the spectrum or per a specific designed wave length.

g. The material may glow, such as provided by chemically luminescent materials.

h. The material may be a paint or skin covering on the munition that spalls or disintegrates off the impacting munition and is applied to the impacted vehicle. The identification material would then have one of the above properties.

i. The identification material may consist of several different types of identification materials, each tailored for a specific need or condition.

I claim:

1. In a missile disposed for flight in a trajectory ending at a target, said missile comprising a warhead which substantially destroys said target and means for marking said destroyed target to indicate a disabled target responsive to impact of said warhead with said target;

at least one housing carried by said missile, said housing being separate and distinct from said warhead;

a substantially semi-permanent target marking material carried in said housing which adheres to said target responsive to impact of said warhead and said housing with said target, said target marking material serving as an indication that said target has been substantially destroyed as a result of said warhead impact therewith and that no further munitions need to be expended at the target.

2. Apparatus as in claim 1 wherein said housing is provided with a cylindrical configuration defined by substantially parallel forward and rear end walls and an intermediate connecting annular wall, and a frangible plug means disposed in said annular wall for rupturing responsive to impact of said warhead with said target.

3. Apparatus as in claim 2 wherein said frangible plug means is an annular member disposed around the periphery of said annular portion of said housing.

4. Apparatus as set forth in claim 3 including a plurality of said housings disposed in spaced serial relation along the length of said missile.

5. Apparatus as set forth in claim 3 including an initiator means for rupturing said housing responsive to impact of said warhead with said target.

6. Apparatus as in claim 1 wherein said housing is defined by a plurality of strakes externally positioned on a body of said missile, said strakes having aerodynamically configured surfaces and being positioned in spaced relation around the periphery of said missile and having a chamber therein, said marker material being carried in said chamber of each said strake.

7. Apparatus as set forth in claim 1 wherein said housing defined by at least one packet/conformal container which includes a bottom surface mating with said body of said missile, an upper surface having a substantially central flat surface, and a pair of curved side surfaces extending downwardly from said upper flat surface for mating relation with said bottom surface, and a pair of spaced end surfaces which are sloped downwardly and outwardly for mating relation with said bottom surface, said upper, side, end and bottom surfaces enclosing a chamber having said target marker material therein.

8. Apparatus as in claim 1 wherein said housing is defined by a plurality of packet/conformal containers, said containers are serially mounted in pairs on said missile with each pair including a first forward container and a second aft container, said pairs being substantially equally spaced around the periphery of the body of said missile.

9. Apparatus as set forth in claim 1 including a trailing body secured to a flechette, said trailing body having said marker material housed therein.

10. Apparatus as set forth in claim 1 wherein said missile is defined as a free flying projectile.

11. Apparatus as set forth in claim 10 wherein said free flying projectile is provided with forward and aft ends, said forward end forming said warhead and said aft end having said marker material housing secured thereto.

12. Apparatus as set forth in claim 10 wherein said free flying projectile has a trailing body secured thereto, said trailing body forming said housing for said marker material.

13. Apparatus as in claim 1 wherein said missile is a wire guided anti armor missile.

14. Apparatus as in claim 1 wherein said missile is a radar/millimeter wave/laser/optically guided missile.

15. Apparatus for substantially destroying a target and for substantially simultaneously marking the target during the destroying act to make evident that said target is no longer active and a threat, said apparatus comprising:

a missile having a warhead which substantially destroys said target;

at least one housing carried by said missile, said housing being separate and distinct from said warhead;

target marking means carried in said housing disposed which adheres to said target responsive to impact of said warhead with said target, said target marking means comprising a semi-permanent marking material which provides an indication that said target has been substantially destroyed by said warhead and that no further engagement of said target with additional munitions are required.

16. Apparatus as in claim 15 wherein said target is an armored vehicle.

* * * * *